US008511233B2

(12) United States Patent
Nilsson

(10) Patent No.: US 8,511,233 B2
(45) Date of Patent: Aug. 20, 2013

(54) PROJECTILE FOR FIRE ARMS

(75) Inventor: Åke Nilsson, Arvika (SE)

(73) Assignee: Norma Precision AB, Åmotfors (SE)

( * ) Notice: Subject to any disclaimer, the term of this patent is extended or adjusted under 35 U.S.C. 154(b) by 226 days.

(21) Appl. No.: 12/479,159

(22) Filed: Jun. 5, 2009

(65) Prior Publication Data

US 2009/0308275 A1 Dec. 17, 2009

(30) Foreign Application Priority Data

Jun. 11, 2008 (SE) ..... 0801362

(51) Int. Cl.
*F42B 12/06* (2006.01)

(52) U.S. Cl.
USPC ..... 102/509; 102/521; 102/526

(58) Field of Classification Search
USPC ..... 102/509, 524, 507, 521, 503, 508, 102/510, 526, 527, 517, 518, 519, 525; 86/55; 89/1.1; D22/116
See application file for complete search history.

(56) References Cited

U.S. PATENT DOCUMENTS

| | | | | | |
|---|---|---|---|---|---|
| 157,049 | A | * | 11/1874 | Wiard | 102/521 |
| 815,992 | A | * | 3/1906 | Wheeler et al. | 102/526 |
| 1,040,924 | A | * | 10/1912 | Friedrick | 102/526 |
| 1,234,653 | A | | 7/1917 | Gaynor | |
| 1,582,673 | A | * | 4/1926 | Fahrenwald | 148/432 |
| 1,681,295 | A | * | 8/1928 | Johnson | 102/509 |
| 2,456,011 | A | * | 12/1948 | Musser | 89/1.1 |
| 3,154,016 | A | | 10/1964 | Frey et al. | |
| 3,157,137 | A | * | 11/1964 | Burns, Jr. | 102/509 |
| 3,695,181 | A | * | 10/1972 | Bull et al. | 102/522 |
| 3,913,489 | A | * | 10/1975 | Travor et al. | 102/526 |
| 4,136,616 | A | * | 1/1979 | Schirneker | 102/510 |
| 4,193,348 | A | * | 3/1980 | Halverson | 102/509 |
| 4,610,061 | A | * | 9/1986 | Halverson | 86/55 |
| 4,878,434 | A | * | 11/1989 | Sommet | 102/514 |
| 4,879,953 | A | * | 11/1989 | Carter | 102/507 |
| 4,932,326 | A | * | 6/1990 | Ladriere | 102/364 |
| 5,187,325 | A | | 2/1993 | Garvison | |
| 5,259,320 | A | * | 11/1993 | Brooks | 102/509 |
| 5,357,866 | A | | 10/1994 | Schluckebier et al. | |
| 5,463,960 | A | | 11/1995 | Lowry | |
| 5,515,787 | A | * | 5/1996 | Middleton | 102/503 |
| 5,686,693 | A | * | 11/1997 | Jakobsson | 102/501 |
| D389,221 | S | | 1/1998 | Borg | |
| 6,070,532 | A | * | 6/2000 | Halverson | 102/501 |
| 6,105,506 | A | * | 8/2000 | Gangale | 102/439 |

(Continued)

FOREIGN PATENT DOCUMENTS

| | | |
|---|---|---|
| EP | 0 918 208 A1 | 5/1999 |
| WO | WO 84/02183 A1 | 6/1984 |

OTHER PUBLICATIONS

American National Standards Institute, "Voluntary Industry Preformance Standards for Pressure and Velocity of Centerfire Rife Sporting Ammunition for the Use of Commercial Manufactures," pp. 23-93, SAAMI Voluntary Preformance Standars, Z.299.4 206, 1992.*

*Primary Examiner* — Stephen M Johnson
(74) *Attorney, Agent, or Firm* — Dickstein Shapiro LLP

(57) ABSTRACT

A projectile for fire arms formed in such a way that it includes a front portion of essentially convex axial cross-section that via a transition transforms into a rear portion of essentially cylindrical radial cross-section, which rear portion acts as a power belt for the projectile.

6 Claims, 8 Drawing Sheets

(56) References Cited

U.S. PATENT DOCUMENTS

| | | | | |
|---|---|---|---|---|
| 6,186,071 | B1 * | 2/2001 | Fry | 102/515 |
| 6,237,497 | B1 | 5/2001 | Altenau et al. | |
| D452,894 | S | 1/2002 | Benini | |
| D456,480 | S | 4/2002 | Quinsa et al. | |
| 6,363,856 | B1 * | 4/2002 | Stoker et al. | 102/516 |
| 6,439,125 | B1 | 8/2002 | Carter | |
| 6,776,101 | B1 * | 8/2004 | Pickard | 102/509 |
| D518,727 | S | 4/2006 | Haley et al. | |
| 7,171,905 | B2 * | 2/2007 | Hirt et al. | 102/509 |
| 7,210,411 | B2 * | 5/2007 | Booth et al. | 102/514 |
| 7,299,733 | B2 * | 11/2007 | Eberhart et al. | 86/55 |
| 7,478,595 | B1 | 1/2009 | Herr et al. | |
| D621,468 | S * | 8/2010 | Nilsson | D22/116 |
| 2005/0217529 | A1 * | 10/2005 | O'Dwyer | 102/526 |
| 2007/0006770 | A1 | 1/2007 | Herrlinger | |
| 2007/0068415 | A1 * | 3/2007 | Oertwig | 102/509 |
| 2007/0163459 | A1 | 7/2007 | MacDougall | |
| 2009/0064888 | A1 * | 3/2009 | Polovnev et al. | 102/501 |

* cited by examiner

PROJECTILE FOR FIRE ARMS

FIELD OF THE INVENTION

The invention relates to a projectile for fire arms.

BACKGROUND OF THE INVENTION

It is well-known to design projectiles for fire arms in various ways. This design relates to the structure of the projectile as well as the shape thereof. With structure, reference is made to the construction thereof, i.e., whether the projectile is, e.g., full-jacketed or semi-jacketed as well as the internal design thereof. Usually, a projectile for fire arms comprises a jacket that surrounds, to different extents, a core of preferably lead. Recently, projectiles for fire arms have also begun to be manufactured of other materials than lead, e.g., copper.

The structure of the projectile is most important in hunting, when good shock and depth effect of the game is desired. The shape and structure of the projectile is of significance to the projectile motion in the bore of the barrel of the fire arm, internal ballistics, for the projectile motion in the air, external ballistics, and also for the penetration and motion of the projectile in the target, terminal ballistics.

In all the different known designs mentioned above of a projectile, it has more or less the same basic shape, in that it has the shape of a cylinder having a tapering front end for the formation of the point of the projectile, and a rear end that is cut-off relatively straight or has the shape of a truncated cone for the formation of a boat tail.

During the travel of the bullet through the bore of the barrel, the lands will penetrate and engage the jacket of the projectile to different extents, depending on the type of projectile, in order to provide seal between the jacket/outside of the projectile and the bore as well as to impart rotation to the projectile. Depending on the shape of the projection, either the larger part of the jacket/outside of the cylindrical part of the projectile may form seal against the inside of the bore or only a smaller part, i.e., a so-called power belt of the projectile.

A problem during the travel of the projectile through the bore is that friction arises between the jacket/outside of the projectile and the surfaces in the bore as well as that the jacket/outside in addition is deformed mechanically, when the lands penetrate into the same. This decreases the muzzle velocity of the projectile, which is a disadvantage in respect of the precision as well as the shock effect of a game.

One way to increase the muzzle velocity of a projectile is by changing, e.g., the amount of and/or kind of gunpowder. This can be made within certain limits, but the maximal gas pressure, which the barrel is dimensioned for, must never be exceeded.

SUMMARY OF THE INVENTION

An object of the invention is to provide a new type of projectile, the muzzle velocity of which can be improved while maintaining the same maximal gas pressure.

Another object of the invention is to provide a new type of projectile the expansion of which in a target may continue even when the velocity of the projectile has decreased.

This object is attained by a projectile for fire arms, wherein it comprises a front portion of essentially convex axial cross-section that via a transition transforms into a rear portion of essentially cylindrical radial cross-section, which rear portion acts as a power belt for the projectile.

Different preferred embodiments are defined in the dependent claims.

BRIEF DESCRIPTION OF THE DRAWINGS

The invention is described in more detail below, reference being made to the accompanying drawing, in which.

DESCRIPTION OF PREFERRED EMBODIMENTS

Figure 1:
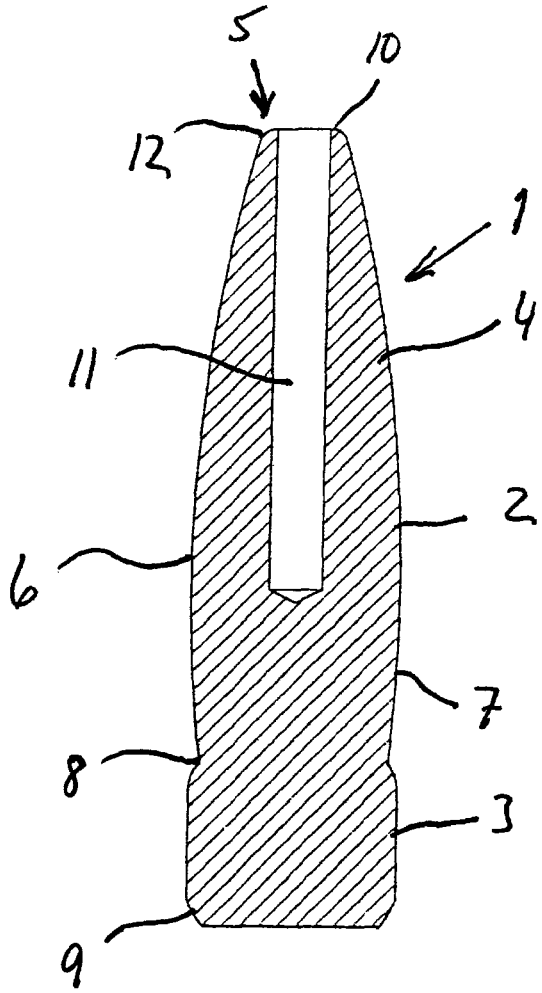
FIG. 1 is a sectioned side view of a first embodiment of a projectile according to the invention.

As is seen in FIG. 1, a projectile 1 for fire arms comprises a front portion 2 of essentially convex axial cross-section that via a transition 8 transforms into a rear portion 3 of essentially cylindrical cross-section. The front portion 2 is in turn divided into, on one hand, an acute portion 4, which extends, as seen in the direction of travel of the projectile, from a point 5 of the projectile 1 to an area 6 where the diameter of the projectile is maximum, at least of subcalibre, in respect of the front portion 2, and on the other hand an intermediate portion 7, which extends from the area 6 to the transition 8 between the front portion 2 and the rear portion 3.

The acute portion 4 and the intermediate portion 7 of essentially convex axial cross-section preferably have the same radius, but may, in an embodiment not shown, have different radii. This radius depends on the calibre of the fire arm. In case of a larger radius, the lands will usually penetrate into the jacket/outside of the projectile, and in case of a smaller radius, the jacket/outside will usually only rest against the lands.

The length of the front portion 2 depends on the desired stability and weight of the projectile, which in turn depend on the calibre of the fire arm.

The transition 8 may consist of an axially extended area in the form of a rounding having a radius or an oblique line as seen in axial cross-section, i.e., a truncated cone; in the drawing, the transition 8 is shown in the form of a rounding. The smallest diameter of the transition 8 should be smaller than the largest diameter of the front and the rear portion 2, 3, respectively, and always be smaller than the distance between two diametrically opposed lands (the calibre gauge). The shape of the transition 8 has the purpose of decreasing the air resistance.

The rear portion 3 forms a so-called power belt for providing a gas seal against the bore. This power belt has a full calibre. The axial length of the rear portion 3 may vary depending on the calibre of the projectile, and should have such an axial length that a good gas seal is obtained as well as that sufficient rotational force is transferred from the lands to the projectile. The rear portion 3, as seen in the negative direction of travel of the projectile, may terminate in a boat tail 9.

Furthermore, at least a part of the power belt should be in engagement with the case neck of a case, preferably at least at the lower portion of the case neck.

By designing the projectile 1 in the way mentioned above, it is possible to increase the muzzle velocity of the projectile with a maintained maximum gas pressure.

In addition, by this design, it is possible that the projectile 1 gets a high sectional density, i.e., the ratio between the weight and cross-sectional area thereof, at the same time as the contact surface thereof against the bore can be made small in order to decrease friction and mechanical deformation during the travel of the projectile through the bore. In this way, a projectile is obtained having a higher muzzle velocity while maintaining the same maximal gas pressure than a conventional projectile having the same low air resistance.

It should be mentioned that, in order for a projectile to get favourable sectional density values, it should be made as long as possible, which however cannot be exaggerated too much, since the rotation that it is imparted during the way thereof through the bore does not only bring the projectile to rotate around the longitudinal axis thereof but also gives it a certain wobbling motion during the flight thereof in the air.

The rear portion 3 may be provided with ballast, i.e., with a material that is heavier than the material of the proper projectile body, in order to decrease a possible wobbling projectile motion, particularly when the projectile has a short or no boat tail 9.

The embodiment shown in FIG. 1 of the projectile illustrates a projectile 1 of hollow point type. A point 5 is formed with a holed flat surface 10, and an axial blind hole 11 is recessed in the centre of the projectile. Preferably, said hole 11 extends past the area 6. A transition 12 between the flat surface 10 and the acute portion 4 forms a so-called anchor ring, which should have as sharp an edge as possible. This means that the transition 12 preferably should form a corner having an obtuse angle, but because of possible feeding problems of a flat point cartridge provided with the projectile according to the invention, the transition is somewhat rounded. It should be mentioned that the blind hole 11 does not need to have a circular cross-section.

At the area 6 of the projectile 1, the same can be at most of full calibre or at least of subcalibre, i.e., that the area 6 has a diameter that amounts to at least the distance between lands in the bore. In case of subcalibre, the area 6 only rests against the lands, the projectile being of a so called borerider type.

In a preferred embodiment the area 6 of the projectile 1 has full calibre.

In an embodiment not shown, the projectile may be provided with a groove/notch at the area 6, by means of which it is possible to, in a known way, pinch the projectile at the end of the case neck of a case (not shown).

Figure 4:
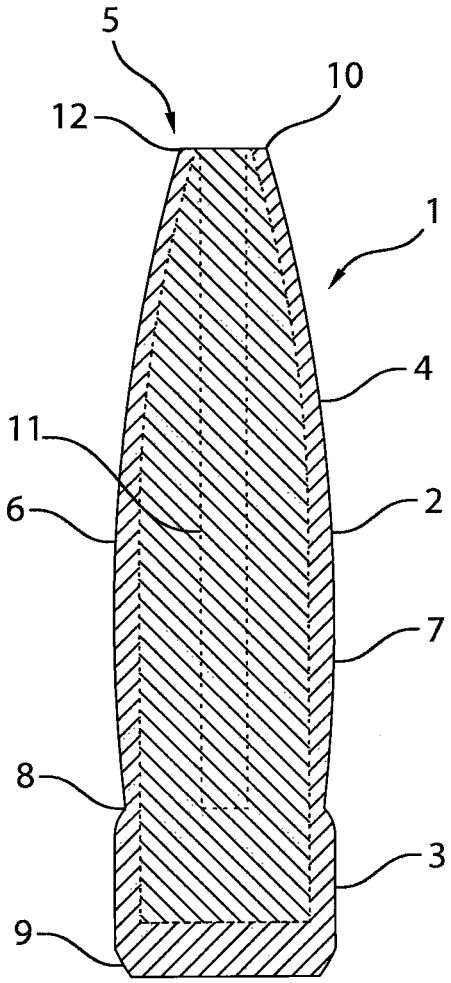
FIG. 4 is a cross-sectional view of an example embodiment of a projectile according to the invention.

In yet another embodiment shown in FIG. 4, the projectile may be provided with a core of lead, which possibly is bonded to the jacket of the projectile. The projectile provided with a core of lead may be of hollow point type, such as is shown in FIG. 1. When the projectile has a core of lead, it is provided with a jacket. In a preferred embodiment of the same projectile provided with a core of lead, the jacket has a wall thickness that gradually increases from the point 5 to becoming maximum preferably where the front portion 2 has the maximum diameter, i.e., at the area 6, so as to after that become thinner in order to facilitate continued expansion when the velocity of the projectile has decreased.

In a projectile of the hollow point type, the jacket forms the wall, as seen in cross-section, between the wall of the hole to the outside of the projectile 1. Also this projectile has thus a wall thickness that gradually increases from the point 5 to becoming maximum preferably where the front portion 2 has the maximum diameter, i.e., at the area 6, so as to after that become thinner.

By this design of the jacket, it is possible to control the expansion of the projectile in the target. This can also be effected by means of, e.g., the velocity of the bullet and the diameter of the blind hole 11. Preferably, the blind hole 11, i.e., the depth thereof, extends past the area 6 having maximum jacket thickness, as seen in the direction of travel of the projectile. More precisely, in one embodiment, be the projectile is made by turning. In this way, it becomes possible to decrease the jacket thickness of the projectile (in a so-called semi-jacketed projectile) or wall thickness (in. e.g., a solid hollow point projectile) after it having had maximum thickness at the area 6. This allows that the projectile can continue to expand, as seen in the cross-direction direction thereof, when the expansion zone reaches this part of the projectile having decreased jacket/wall thickness in spite of the velocity of the projectile already having decreased significantly, thanks to the already obtained expansion up to the part of the projectile having maximum jacket/wall thickness, i.e., in spite of lower velocity of the projectile, it can continue to expand thanks to the jacket/wall thickness decreasing gradually. Thus, by the projectile according to the invention, an additional possibility is obtained of controlling the expansion of the projectile in the target in addition to the higher muzzle velocity.

Figure 3:
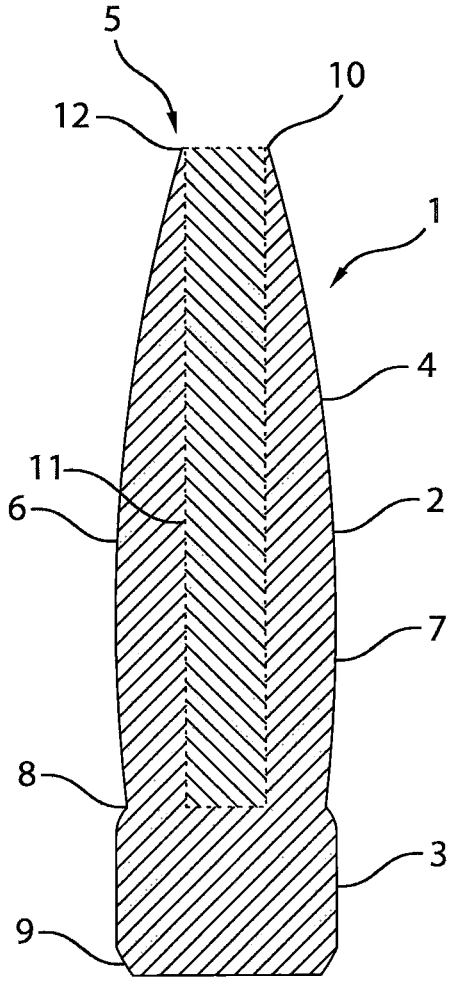
FIG. 3 is a cross-sectional view of an example embodiment of a projectile according to the invention.

In an embodiment shown in FIG. 3, for instance, a projectile having a core of lead and of the hollow point type, the blind hole 11 may extend all the way down to the power belt. In this way, the expansion of the projectile can continue also when the velocity thereof gradually decreases in the target in that the thickness of the jacket of the intermediate portion 7 is smaller than the thickness at the area 6, as has been explained above.

Figure 2:
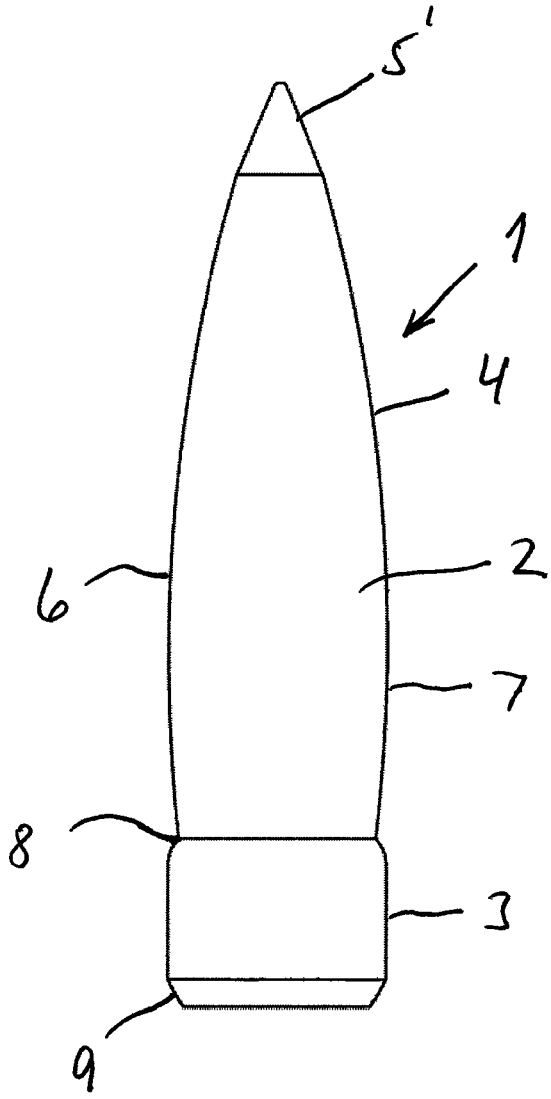
FIG. 2 is a side view of a second embodiment of a projectile according to the invention.

In an additional embodiment, which is shown in FIG. 2, a plastic point 5' may be arranged at the point 5 of the projectile, preferably a plastic point 5' provided with a shank, wherein the shank is threaded into the hole 11. By providing the projectile with such a plastic point 5', the feeding of a cartridge into the bore of the fire arm is facilitated and the aerodynamics of the projectile is improved. In this case, it is also possible to form the transition 12 without a rounding, i.e., with a flat front surface. The advantage of forming the point 5 of the projectile 1 with a flat surface 10, i.e., without a rounding at the transition 12 between the flat surface 10 and the acute portion 4, which forms the anchor ring, is that, since the projectile has a certain wobbling motion, such as has been described above, when the projectile impinges on the target, particularly hard materials such as bones, the sharp edge present at the transition 12 "catch hold" of the material and "raises" the projectile, the projectile aiming toward the normal of the impact surface. This improves the penetration capacity of the projectile into the target as well as prevents rebounding shot against hard materials.

As has been mentioned above, the projectile 1 according to the invention is preferably manufactured by turning in order to obtain the outer contour of the same and may in a suitable way be internally machined so as to be fillable with, e.g., lead. It is evident for a person skilled in the art that it may be filled with other materials, such as tombac (Cu/Zn) or some other suitable alloy. The projectile may also be sintered.

Figure 5:
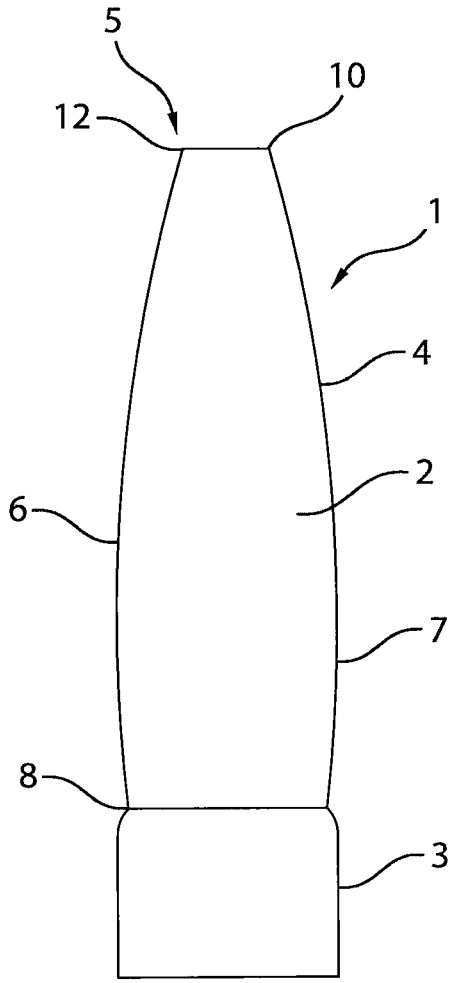
FIG. 5 is a side view of an example embodiment of a projectile according to the invention.
Figure 6:
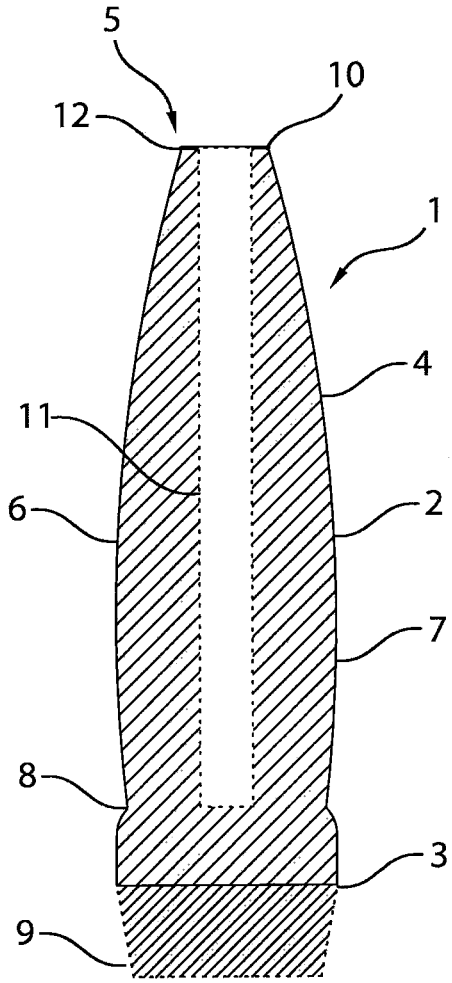
FIG. 6 is a cross-sectional view of an example embodiment of a projectile according to the invention.
Figure 7:
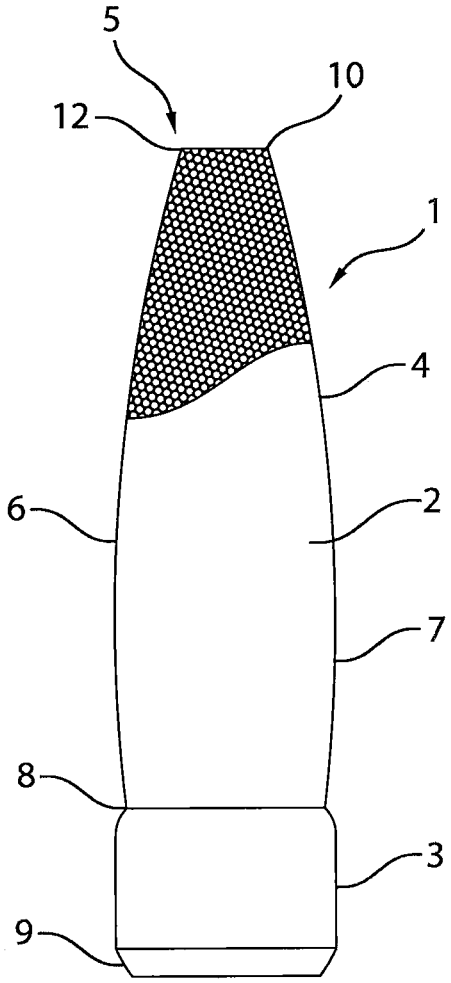
FIG. 7 is a partial cut away side view of an example embodiment of a projectile according to the invention.
Figure 8:
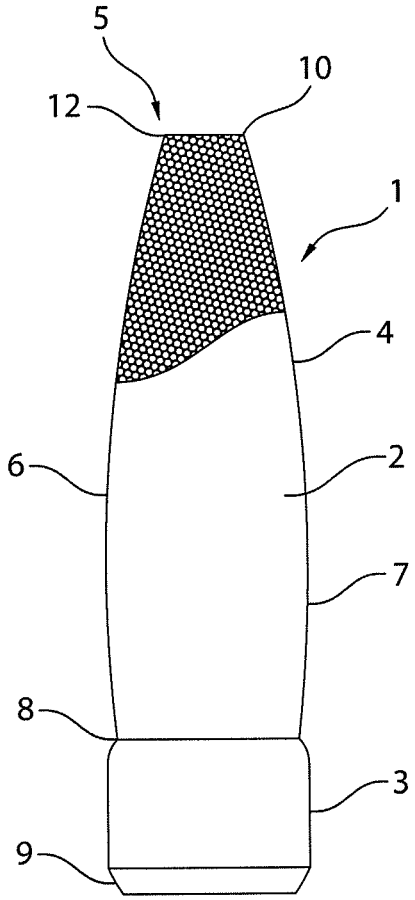
FIG. 8 is a partial cut away side view of an example embodiment of a projectile according to the invention.

The projectile according to the invention is preferably of a type selected from the group consisting of solid, non-expanding, expanding, provided with cavity at the point, as shown in FIG. 1, jacket-provided filled, bonded, as shown in FIG. 4, provided with boat tail (e.g., FIG. 1) or not, as shown in FIG. 5, provided with ballasted boat tail, as shown in FIG. 6, and sintered, as shown in FIG. 7.

It should be noted that the dotted portions of FIGS. 3, 4 and 6 do not represent specific shapes or dimensions.

What is claimed is:

1. Projectile for fire arms, the projectile comprising:

a front portion of convex axial cross-section over the full axial length thereof that, via a transition portion, transforms into a rear portion of cylindrical radial cross-section, which rear portion acts as a power belt for the projectile, the front portion consisting of:

an acute portion, the entirety of which having a curved axial cross-section and extending from a front point of the projectile to an area where the front portion has a maximum diameter; and an intermediate portion, the entirety of which having a curved axial cross-section and extending from the area where the front portion has the maximum diameter to the transition portion, the transition portion extending to the rear portion, wherein the transition portion has a curved axial cross-section, and wherein the rear portion has a diameter that is equal to the maximum diameter.

2. Projectile according to claim 1, wherein the transition portion consists of an axially extended area in the form of a rounding as seen in axial cross-section.

3. Projectile according to claim 1, wherein the projectile is of a type selected from the group consisting of expanding, provided with a cavity at the front point, jacket-provided filled, bonded, provided with a boat tail or not, provided with a ballasted boat tail, and sintered.

4. Projectile according to claim 3, wherein, in the case of an expanding projectile having an outer surface and a blind hole with an inner wall extending in an axial direction from the front portion of the expanding projectile, the thickness between the inner wall of the blind hole and the outer surface of the expanding projectile increases gradually from the front point of the projectile and is maximum at the area where the front portion has the maximum diameter as seen in the direction of cross-section and after that decreases in order to facilitate continued expansion when the velocity of the projectile has decreased.

5. Projectile according to claim 1, wherein a blind hole, which begins at the front point of the projectile and which extends in the axial direction of the projectile, is so deep that it extends past the area where the front portion has the maximum diameter as seen in the direction of cross-section.

6. Projectile according to claim 1, wherein the front point of the projectile is provided with an anchor ring.

* * * * *